US006855067B2

(12) United States Patent
Solheim et al.

(10) Patent No.: US 6,855,067 B2
(45) Date of Patent: Feb. 15, 2005

(54) GOLF CLUB WITH HOSEL CAVITY WEIGHT

(75) Inventors: John A. Solheim, Phoenix, AZ (US); Richard R. Sanchez, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/357,624

(22) Filed: Feb. 3, 2003

(65) Prior Publication Data

US 2004/0152536 A1 Aug. 5, 2004

(51) Int. Cl.[7] ..... A63B 53/04

(52) U.S. Cl. ..... 473/310; 473/312; 473/246; 473/345; 473/339

(58) Field of Search ..... 473/345, 335, 473/338, 339, 309, 312, 245, 246, 248, 310

(56) References Cited

U.S. PATENT DOCUMENTS

| | | | | | |
|---|---|---|---|---|---|
| 1,133,129 | A | | 3/1915 | Govan | |
| 1,167,106 | A | | 1/1916 | Palmer | |
| 1,538,312 | A | | 2/1925 | Beat | |
| 1,562,956 | A | | 3/1925 | Guerne | |
| 1,840,924 | A | | 1/1932 | Tucker | |
| 3,410,558 | A | * | 11/1968 | Reuter, Jr. | 473/309 |
| 4,854,583 | A | * | 8/1989 | Kobayashi | 473/312 |
| 4,869,507 | A | | 9/1989 | Sahm | |
| 5,058,895 | A | | 10/1991 | Igarashi | |
| 5,141,230 | A | | 8/1992 | Antonious | |
| 5,219,408 | A | | 6/1993 | Sun | |
| 5,851,160 | A | | 12/1998 | Rugge et al. | |
| 5,906,549 | A | * | 5/1999 | Kubica | 473/314 |
| 2003/0004009 | A1 | * | 1/2003 | Hoffman et al. | 473/312 |

* cited by examiner

*Primary Examiner*—Stephen Blau
(74) *Attorney, Agent, or Firm*—Darrell Marquette

(57) ABSTRACT

A metal wood-type golf club has a hollow body with a hosel bore disposed in the heel end. A hosel bore weight, selected from a plurality of hosel bore weights of different mass, is inserted into the bottom end of the hosel bore. Thereafter, the tip of a golf club shaft is inserted into the hosel bore and secured to the head to finish the club. The hosel bore weights preferably comprise weights of substantially identical size and shape adapted to conform to the interior surface of the bottom end of the hosel bore with the mass of the hosel bore weights being adjusted by varying their density.

7 Claims, 3 Drawing Sheets

GOLF CLUB WITH HOSEL CAVITY WEIGHT

BACKGROUND OF THE INVENTION

This invention relates generally to golf clubs, in particular, to so-called metal wood-type golf clubs.

Golf clubs known as "woods" traditionally have a head made of a suitable wooden material such as maple or persimmon attached to one end of an elongated shaft. These traditional wood club heads are usually solid and are shaped with their weight properly distributed about their center of gravity to maximize performance. Golf club "wood" heads have also been formed of suitable metals such as stainless steel and titanium. Metal wood heads are usually hollow so as to minimize weight while leaving the maximum amount of material available for the structural components of the head. Various attempts have been made to distribute weight in metal wood heads with respect to their centers of gravity so that the performance is maximized. Such attempts have included placing different types and numbers of weight members at different locations on or inside the metal heads. Examples of such attempts are disclosed in prior U.S. Pat. No. 4,869,507 to Sahm; U.S. Pat. No. 5,058,895 to Igarashi; U.S. Pat. No. 5,141,230 to Antonious; U.S. Pat. No. 5,219,408 to Sun; and U.S. Pat. No. 5,851,160 to Rugge, et al.

The Sahm patent teaches that lowering the center of gravity of a club head would tend to add more loft to a golf shot. Igarashi teaches that perimeter weighting increases the moment of inertia of a wood type club about its center of gravity. The increased moment of inertia causes the club to resist twisting when a ball is not struck at the "sweet spot", that is, the point on the club face at which a line normal to the face passes through the club head's center of gravity. Reducing the twisting causes the ball to travel with less loss of directional control. Antonious teaches a hollow metal wood club having an internal weighted mass integrally formed with the under side of the upper section of the club head shell that is combined with another mass placed directly behind or adjacent to the center of percussion of the ball striking face. Sun teaches threading a plurality of individual weights into the sole plate of the club head from outside. Rugge teaches use of a weight pad located within the cavity of the hollow metal head along the sole portion. The weight pad is positioned so that the center of gravity of the golf club head is located beneath the center of the impact face and closer to the heel portion than the toe portion. According to Rugge, by positioning the weight pad closer to the heel portion, the moment of inertia about the center of gravity of the golf club is increased while minimizing the increase in moment of inertia about the shaft axis. Among the disadvantages of the aforementioned prior art patents, however, is that weight pads that are integrally formed or attached inside the cavity of the golf club head such as disclosed in Antonious and Rugge cannot be adjusted once the club head is assembled. Conversely, externally attached inserts such as disclosed in Sun mar the appearance of the sole plate of the club and may come loose during use.

SUMMARY OF THE INVENTION

The present invention comprises a metal wood-type golf club comprising a hollow body with a top wall, a bottom wall and a front wall configured for impacting a golf ball. The hollow body has a hosel bore disposed in the heel end behind the body front wall extending downwardly from an upper open end at the body top wall. According to one embodiment, a hosel bore weight is inserted into the bottom end of the hosel bore. Thereafter, the tip of a golf club shaft is inserted into the hosel bore and secured to the head to finish the club. The hosel bore weight may be chosen from a group of hosel bore weights of different mass. The hosel bore weights preferably comprise weights of substantially identical size and shape adapted to conform to the interior surface of the bottom end of the hosel bore. The mass of the hosel bore weights is adjusted by varying their density. According to one embodiment, the hosel bore weights comprise a polyurethane resin loaded with a powdered metal such as tungsten, copper or steel. The density of the cured polyurethane resin is varied by varying the type of metal and/or the quantity of metal suspended in the polyurethane resin. The hosel bore weights themselves have a unique ogival shape (an ogive being defined as a surface of revolution resulting from revolving an arc about an axis on the concave side of the arc). Locating the weight directly beneath the shaft tip maximizes the effectiveness of the hosel bore weight in increasing the moment of inertia of the club about the center of mass of the club, which increases the club's resistance to twisting when the ball is struck off-center. At the same time, the location of the hosel bore weight substantially along the axis of the shaft minimizes the increase in the moment of inertia about the shaft axis, which improves the speed at which the head comes around to a perpendicular position for impacting the golf ball. Moreover, by positioning the weight within the hosel bore, the weight can be selected after the head has been fully assembled (before installation of the shaft) allowing for the weight to be selected to optimize performance of the club head without affecting the external appearance of the club.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
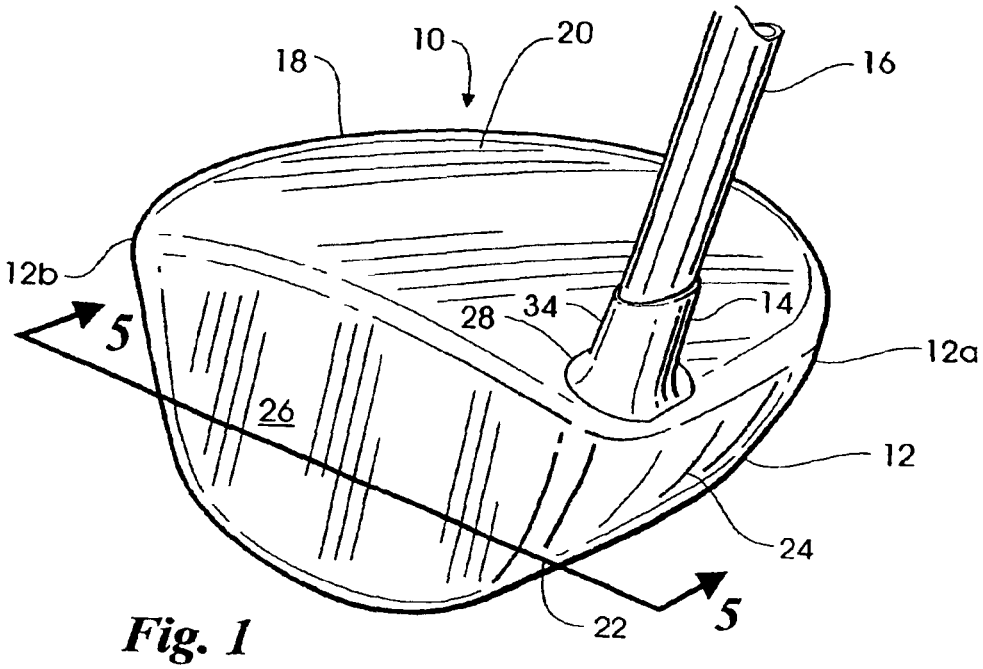
FIG. 1 is a perspective view of a golf club incorporating features of the present invention.
Figure 2:
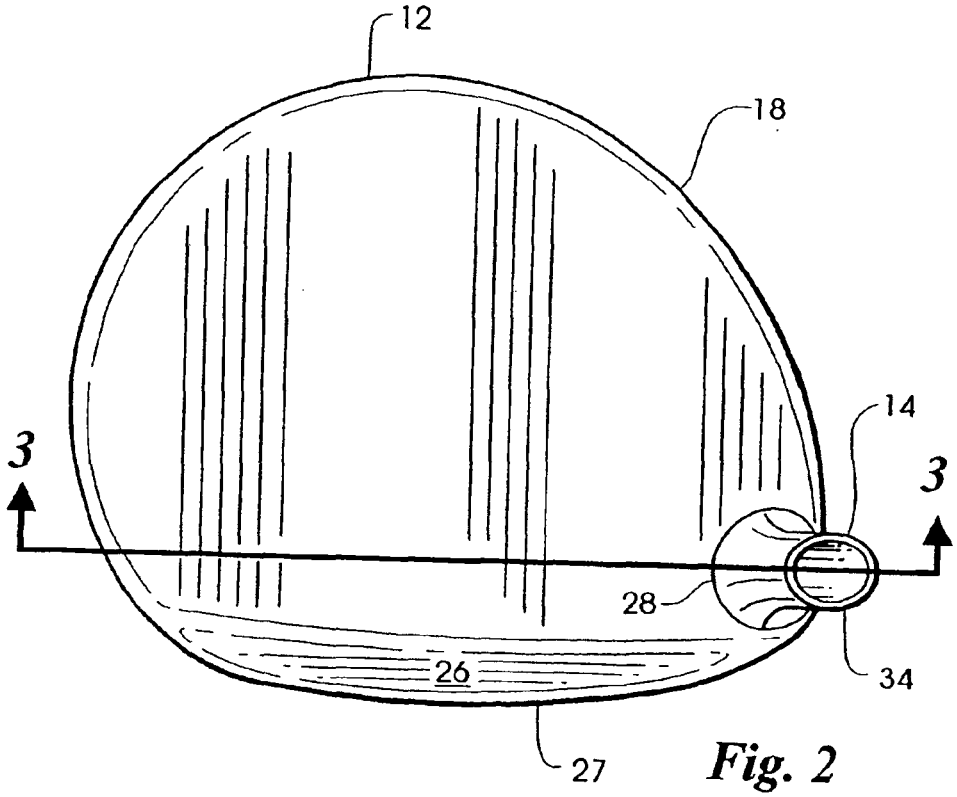
FIG. 2 is a top plan view of the golf club head of FIG. 1.

The drawing figures are intended to illustrate the general manner of construction and are not necessarily to scale. In the detailed description and in the drawing figures, specific illustrative examples are shown and herein described in detail. It should be understood, however, that the drawing figures and the detailed description are not intended to limit the invention to the particular form disclosed, but are merely illustrative and intended to teach one of ordinary skill how to make, and or use the invention claimed herein and for setting forth the best mode for carrying out the invention.

Figure 3:
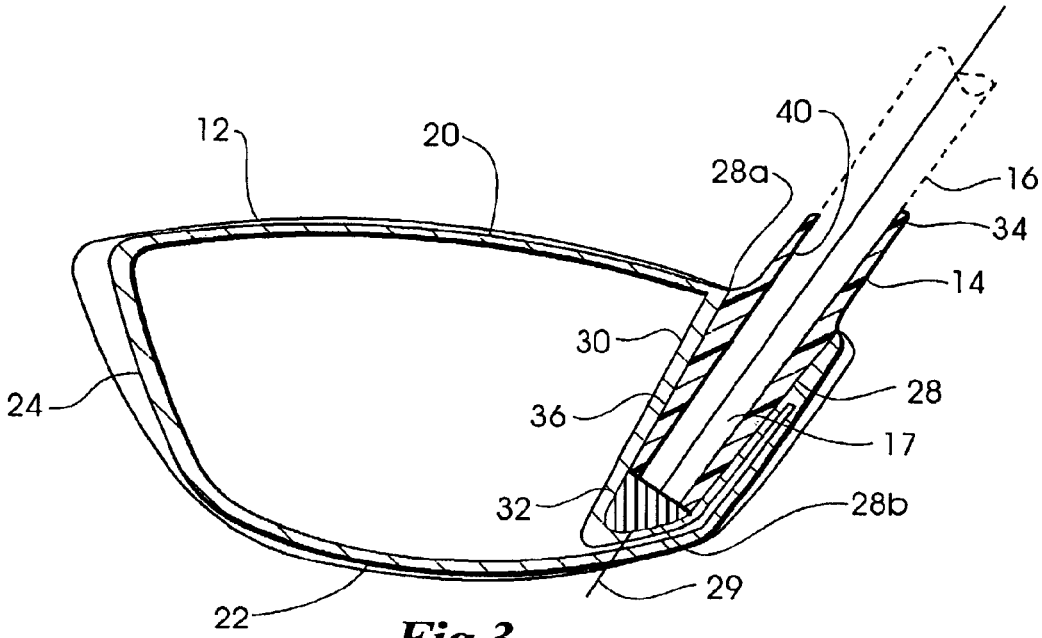
FIG. 3 is a sectional view taken along line 3—3 of FIG. 2.

FIG. 1 depicts a golf club 10 comprising a head 12, a hosel 14 and a shaft 16. Head 12 is composed of a hollow body 18 made of a first material such as titanium having a high shear modulus of elasticity and a high strength to weight ratio. The hollow body 18 has a top wall 20, a bottom wall 22, and a side wall 24 connecting the top wall 20 to the bottom wall 22. Hollow body 18 has a front wall 26 configured to impact a golf ball during use. Head 12 further defines a heel end 12*a* and a toe end 12*b*. A hosel bore 28 is provided in the heel end 12*a* of head 12. Hosel bore 28 extends downwardly from the body top wall 20 toward the body bottom wall 22. Hosel bore 28 has a top end 28*a* that is open and a bottom end 28*b* that is closed. As seen in FIG. 3, the top end 28*a* of hosel bore 28 is substantially flush with the top wall 20 of body 18, and the bore bottom end 28*b* is spaced from the bottom wall 22 of hollow body 18. The hosel bore 28 is defined by a lateral wall 30 connected with a side wall 24 of the hollow body 18.

Figure 4:
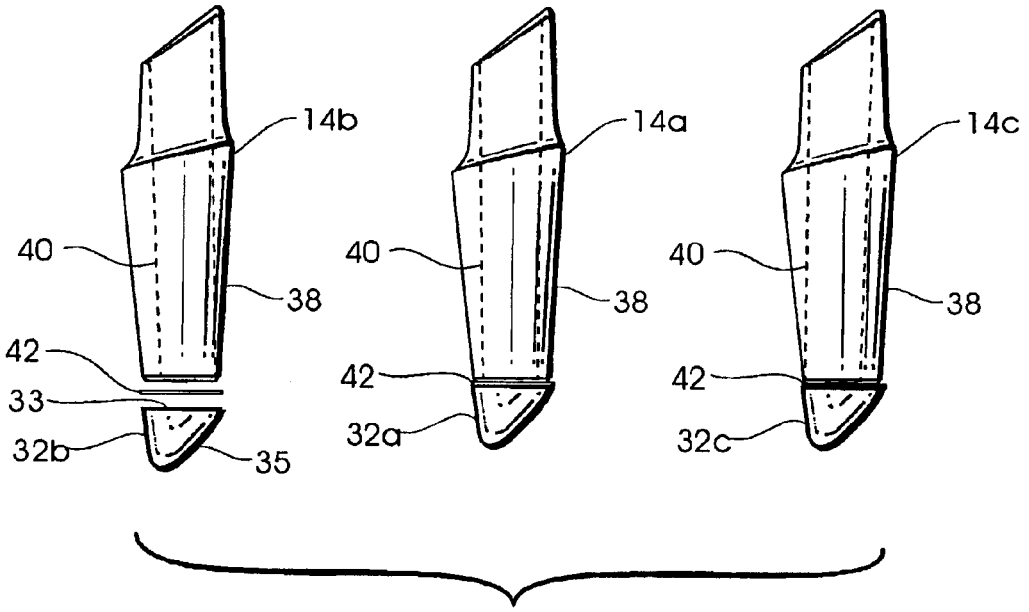
FIG. 4 is a front elevational view of a plurality of hosel inserts and hosel bore weights incorporating features of the present invention.
Figure 5:
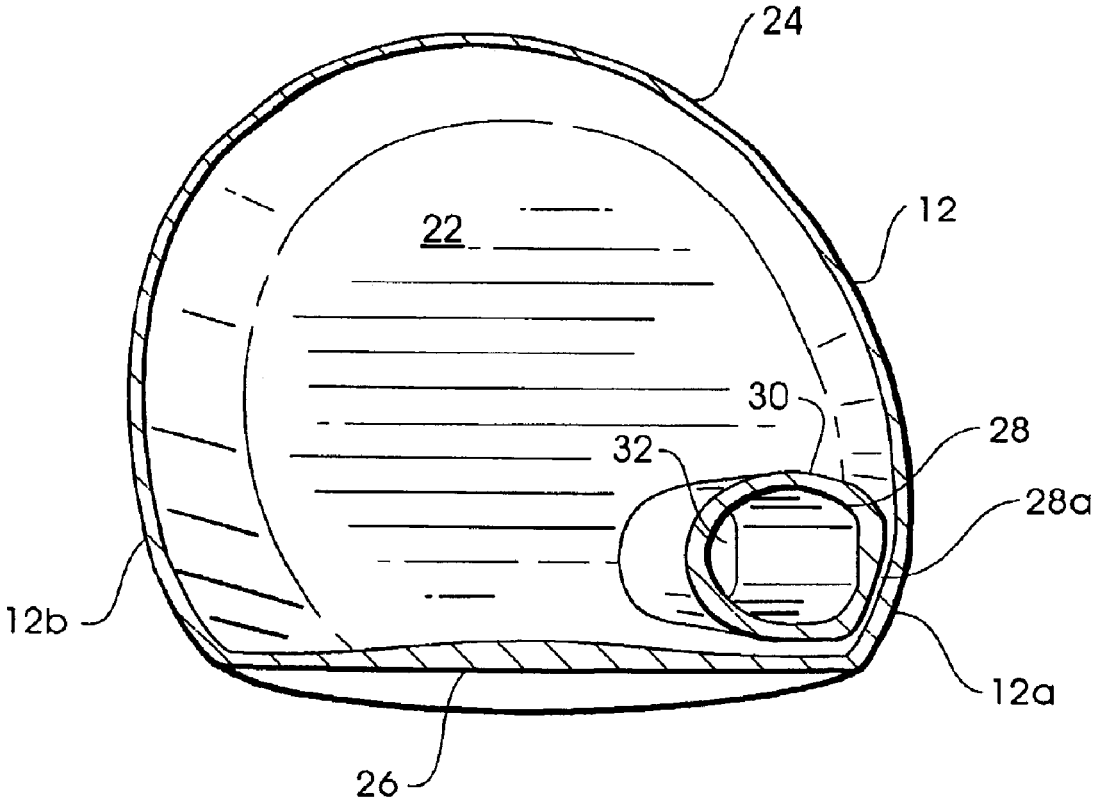
FIG. 5 is a sectional view taken along line 5—5 of FIG. 1.

As disclosed in U.S. Pat. No. 5,954,596 to Noble, et al. and assigned to the assignee of the present invention (the contents of which are incorporated herein by this reference), hosel 14 may be formed of a second material such as plastic having a low shear modulus of elasticity. Hosel 14 includes an upper portion 34 that extends upwardly from the top wall 20 of hollow body 18 and a lower portion 36 that is inserted into hosel bore 28. Hosel 14 also has a substantially longitudinal passage 40 extending through its upper and lower portions 34 and 36. As shown in FIG. 4, a plurality of hosels 14*a*, 14*b*, 14*c* may be provided in which longitudinal passage 40 is disposed at different angles and/or translational positions relative to outer surface 38 of hosels 14*a*, 14*b* and 14*c*.

Shaft 16 is made of a third material, preferably graphite, having a low shear modulus of elasticity. Shaft 16 has a tip end 17 received in the longitudinal passage 40 of hosel 14. The shaft tip 17 extends completely through the hosel 14. In the preferred embodiment of the golf club 10 the shear modulus of elasticity of the hosel 14 is closer to the shear elastic modulus of the shaft 16 than to the shear elastic modulus of the head 12. This relationship of elastic moduli causes the hosel 14 to absorb more of the shock resulting from the head 12 striking a golf ball on front surface 26. Therefore, less shock is transmitted to the shaft 16 which prevents breakage of the shaft 16 and permits the shaft 16 to have a weaker tip end 17 which reduces costs.

With reference to FIGS. 3 and 4, a hosel bore weight 32 is disposed in hosel bore 28 at bottom end 28*b* thereof. Hosel bore weight 32 comprises a unitary solid member having a planar upper surface 33 and a substantially ogival bottom surface 35 that conforms with the bottom surface 28*b* of hosel bore 28. A plurality of hosel bore weights 32*a*, 32*b*, 32*c* of substantially identical size and shape but having different masses are provided. According to a preferred embodiment hosel bore weights 32*a*, 32*b* and 32*c* comprise a polymer such as polyurethane, the density of which may be varied by suspending a metallic powder such as tungsten, copper or steel powder in the polymer resin. The density of the resin is selected by varying the type of metal and/or the ratio of powder to resin. Hosel bore weight 32 may be retained at bottom end 28*b* of hosel bore 28 by conventional means (e.g., adhesives) or may be retained by interference between the hosel bore and the hosel. In a preferred embodiment, hosel bore weight 32 is positioned in its proper orientation within hosel bore 28 by means of a thin film adhesive 42 that allows hosel bore weight 32 to be attached to hosel 14. Thereafter, the entire assembly comprising hosel 14, hosel bore weight 32 and thin film adhesive 42 is inserted into hosel bore 28 and secured in place with adhesive.

As can be determined by the foregoing, providing a plurality of hosel bore weights the appropriate one of which can be selected after the club head has been fully assembled, enables the swing weight, center of gravity and moment of inertia of the club head to be fine tuned to account for variations in manufacturing tolerances and for individual golfer preferences. The location of the hosel bore weight permits a desirable lowering of the center of mass of the club and because the centroid of the hosel bore weight is approximately in line with the shaft axis, according to the parallel axis theorem, the hosel bore weight produces a greater increase in the moment of inertia of the club about its center of gravity then it does about the shaft axis. This provides for an optimally increased moment inertia to resist twisting in the event of an off-center hit while at the same time providing for a club with sufficiently low moment of inertia around the shaft axis that the club head comes around properly during the swing to a perpendicular position for impacting the golf ball.

Although certain illustrative embodiments and methods have been disclosed herein, it will be apparent from the foregoing disclosure to those skilled in the art that variations and modifications of such embodiments and methods may be made without departing from the spirit and scope of the invention. Accordingly, it is intended that the invention should be limited only to extent required by the appended claims and the rules and principals of applicable law.

What is claimed is:

1. A golf club comprising:

a club head comprising a hollow body having a heel end and a toe end, said hollow body comprising a top wall, a bottom wall, and a front wall adapted for impacting a golf ball, said hollow body further comprising a hosel bore disposed in said heel end behind said body front wall extending downwardly from an upper open end at said body top wall toward a closed bottom end proximal said body bottom wall;

a hosel comprising a hosel body having an upper surface, a lower surface and a lateral outer surface adapted to conform to a corresponding inner surface of said hosel bore, said hosel further comprising a passage extending generally lengthwise of said hosel body for receiving the tip end of a golf club shaft, said passage disposed at a predetermined angle relative to said lateral outer surface of said hosel body;

a hosel bore weight selected from a plurality of hosel bore weights, said hosel bore weight comprising a non-cylindrical body sized and shaped to conform to said closed bottom end of said hosel bore without interference, said hosel bore weight being adhesively attached to said lower surface of said hosel body; and a shaft having a tip end received in and attached to said passage in said hosel body.

2. The golf club of claim 1, wherein:

said plurality of hosel bore weights comprise unitary bodies of different masses.

3. The golf club of claim 1, wherein:

said plurality of hosel bore weights comprise solid unitary bodies of different density.

4. The golf club of claim 1, wherein:

each of said plurality of hosel bore weights comprises a solid body having a first end and a second end, said first end having a substantially planar surface and said second end having an ogival surface.

5. The golf club of claim 1, wherein:

said hosel bore weight comprises a metallic powder suspended in a polymer resin.

6. The golf club of claim 1, wherein:

said hosel is selected from a plurality of hosels, each of said plurality of hosels comprising a body having a passage therethrough disposed at a predetermined angle relative to said outer surface of said body, said angle being different for each of said plurality of hosels.

7. A method of making a golf club comprising:

forming a head comprising a hollow body having a heel end and a toe end, said hollow body comprising a top wall, a bottom wall, and a front wall adapted for impacting a golf ball;

forming a hosel bore in said heel end of said hollow body behind said body front wall extending downwardly from an upper open end at said body top wall toward a closed bottom end proximal said body bottom wall;

providing a hosel comprising a hosel body having an upper surface, a lower surface and a lateral outer surface adapted to conform to a corresponding inner surface of said hosel bore, said hosel body further including a passage extending generally lengthwise thereof, said passage disposed at a predetermined angle relative to said lateral outer surface of said hosel body, said angle being different for each of said plurality of hosels;

providing a plurality of hosel bore weights, each of said plurality of hosel bore weights comprising a unitary body having an outer surface adapted to conform to a corresponding inner surface of said hosel bore proximal the bottom end thereof, plural of said plurality of hosel bore weights having different masses;

selecting a hosel bore weight from said plurality of hosel bore weights;

attaching said hosel bore weight to the lower surface of said hosel body;

thereafler inserting said hosel body into said hosel bore: wherein each of said plurality of hosel bore weights comprises a solid body having a first end and a second end, each of said first ends having a substantially planar surface and each of said second ends having an ogival surface.

* * * * *